US006561711B1

(12) United States Patent
Pierpont

(10) Patent No.: US 6,561,711 B1
(45) Date of Patent: May 13, 2003

(54) SHADE EVIDENT COSMETIC PACKAGE

(75) Inventor: Robert L. Pierpont, Meriden, CT (US)

(73) Assignee: Rexam Cosmetic Packaging, Inc., Torrington, CT (US)

( * ) Notice: Subject to any disclaimer, the term of this patent is extended or adjusted under 35 U.S.C. 154(b) by 0 days.

(21) Appl. No.: 10/152,443

(22) Filed: May 21, 2002

(51) Int. Cl.[7] ..... A45D 40/06

(52) U.S. Cl. ..... 401/78; 401/75; 401/98; 401/192

(58) Field of Search ..... 401/78, 77, 75, 401/68, 88, 98, 192

(56) References Cited

U.S. PATENT DOCUMENTS

| | | | | | |
|---|---|---|---|---|---|
| 2,789,692 | A | | 4/1957 | Ferri | |
| 3,091,329 | A | | 5/1963 | Levine | |
| 3,317,036 | A | | 5/1967 | Cherba | |
| 3,531,212 | A | * | 9/1970 | Landen | 401/75 |
| 4,180,163 | A | | 12/1979 | Grioni | |
| 4,208,144 | A | * | 6/1980 | Idec et al. | 401/192 |
| 4,417,827 | A | * | 11/1983 | Kasai et al. | 401/78 X |
| 4,422,545 | A | * | 12/1983 | Kadoory | 401/98 X |
| 4,505,607 | A | * | 3/1985 | Sugiyama | 401/78 |
| 4,579,134 | A | | 4/1986 | Moore | |
| 4,813,801 | A | * | 3/1989 | Cardia | 401/78 X |
| 5,339,483 | A | | 8/1994 | Byun | |
| 5,342,134 | A | * | 8/1994 | Lombardi et al. | 401/78 |
| 5,399,040 | A | * | 3/1995 | Holloway | 401/78 |
| 5,451,113 | A | | 9/1995 | Lund et al. | |
| 5,504,962 | A | | 4/1996 | Byun | |
| 5,851,078 | A | * | 12/1998 | Bow et al. | 401/78 |
| 5,988,919 | A | | 11/1999 | Kuo | |

* cited by examiner

*Primary Examiner*—Gregory Huson
*Assistant Examiner*—Kathleen J. Prunner
(74) *Attorney, Agent, or Firm*—Alston & Bird LLP

(57) ABSTRACT

A cosmetic package is provided for a stick cosmetic, such as lipstick, which allows the color of the lipstick to be visible without opening the package. The package includes a base, a protective sleeve and a collar. The base includes inner and outer cylindrical walls joined at the bottom to form a cylindrical space therebetween. The protective sleeve is adapted to fit into this annular space. The collar is rotatably mounted on the base and has a helical track adapted to engage a corresponding lug on the sleeve. When the collar is rotated, the sleeve is propelled upwardly to surround and protect the cosmetic. When rotated in the other direction, the collar causes the sleeve to be retracted to allow for application of the cosmetic. The protective sleeve may be transparent so that the color shade of the lipstick is evident when the sleeve is in the upwardly extended position surrounding the lipstick.

14 Claims, 3 Drawing Sheets

SHADE EVIDENT COSMETIC PACKAGE

FIELD OF THE INVENTION

This invention relates to a cosmetic package for a stick cosmetic, such as lipstick.

BACKGROUND OF THE INVENTION

Stick cosmetics, such as lipsticks, are usually packaged in a tubular container in which a carrier moves the lipstick from a retracted storage position to an extended position for application of the lipstick. The package is closed by a removable cap. Because lipsticks are offered in many different color shades, the cosmetic package must in some way identify the color shade of the lipstick to the customer. Typically, a label at one end of the package identifies the color shade by a name. A color chart is usually provided near the display of lipstick packages so that the customer may see the color shade corresponding to the name appearing on the label. Frequently, however, the customer may wish to open the lipstick package in order to directly view the color shade of the lipstick. If the lipstick package is sealed, the customer must break the seal in order to open the lipstick. Sometimes, the lipstick may be dented or damaged when the customer opens the package.

The need exists for a lipstick package designed to make it easier for customers to see the color of the product they are :buying. It is therefore an objective of the present invention to provide a cosmetic package that is "shade evident" and thereby enables the customer to directly view the color of the lipstick in the package. The "shade evident" package of the present invention eliminates the need for the customer to open the package in order to see the shade of the product. Also, by eliminating the necessity of opening the package, there is a reduction in damaged goods.

SUMMARY OF THE INVENTION

The present invention provides a cosmetic package for a stick cosmetic, such as lipstick, which comprises a base having inner and outer cylindrical walls defining an annular space therebetween, and a cup adapted for receiving and holding the stick cosmetic. The base carries a rotatable collar. A protective sleeve is positioned in the annular space between the inner and outer cylindrical walls of the base. This protective sleeve cooperates with the rotatable collar so that it is propelled in response to rotation of the collar between an axially extended position for protectively surrounding the stick cosmetic and an axially retracted position in which the stick cosmetic is exposed. The protective sleeve is preferably transparent so that the color shade of the lipstick can be seen when the protective sleeve is in the extended position.

More specifically, the package is formed in three pieces: a base, a protective sleeve and a collar. The base has a cup at its upper end adapted for receiving and holding the stick cosmetic, and it includes inner and outer cylindrical walls which are joined at the bottom to form an annular space therebetween. The protective sleeve is adapted to fit into this annular space. The collar is rotatably mounted on the base and has a helical track adapted to engage a corresponding lug on the protective sleeve. When the collar is rotated in one direction, the sleeve is propelled upwardly to surround and protect the cosmetic. When rotated in the other direction, the collar causes the sleeve to be retracted to allow for application of the cosmetic. The package can also include a separate cap, which may also be transparent.

BRIEF DESCRIPTION OF THE DRAWINGS

Some of the features and advantages of the invention having been described, others will become apparent from the detailed description which follows, and from the accompanying drawings, in which.

DETAILED DESCRIPTION

The present invention will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
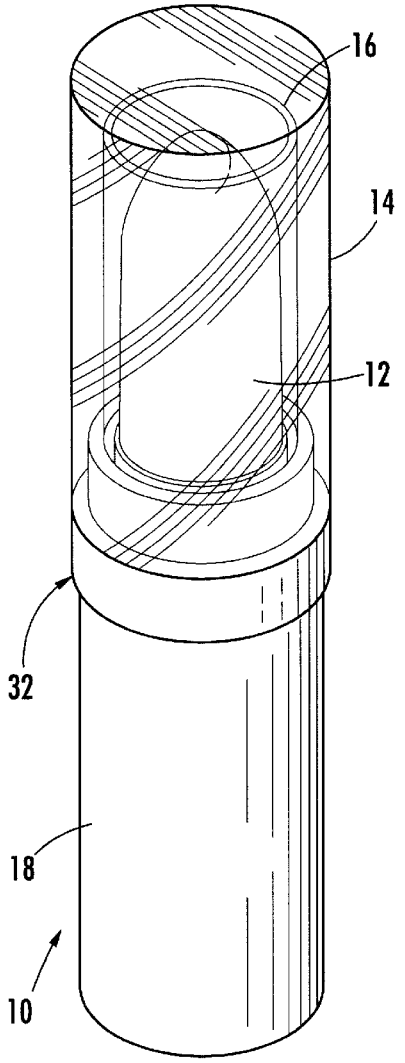
FIG. 1 is a perspective view showing a cosmetic package in accordance with one embodiment of the present invention.

The present invention as shown and described herein is a package for lipstick. However, it should be evident that the package has utility for various other kinds of products in stick form. The lipstick package of the present invention, indicated by the reference character 10, is designed for dispensing lipstick 12 so that it may be cosmetically applied. The package 10 is also designed so that the lipstick 12 is visible inside the package in order that the customer can see the color shade of the lipstick. To this end, the lipstick package 10 includes a removable protective tubular cap 14, which in the illustrated embodiment is formed from a transparent plastic material, connected to a rotatable collar 32. As seen in FIG. 1, the lipstick 12 is surrounded by a protective sleeve 16. The sleeve 16 prevents inadvertent damage to the lipstick when the cap 14 is being removed or replaced. The cap 14 is positioned so as to surround a major portion of the sleeve 16.

Figure 3:
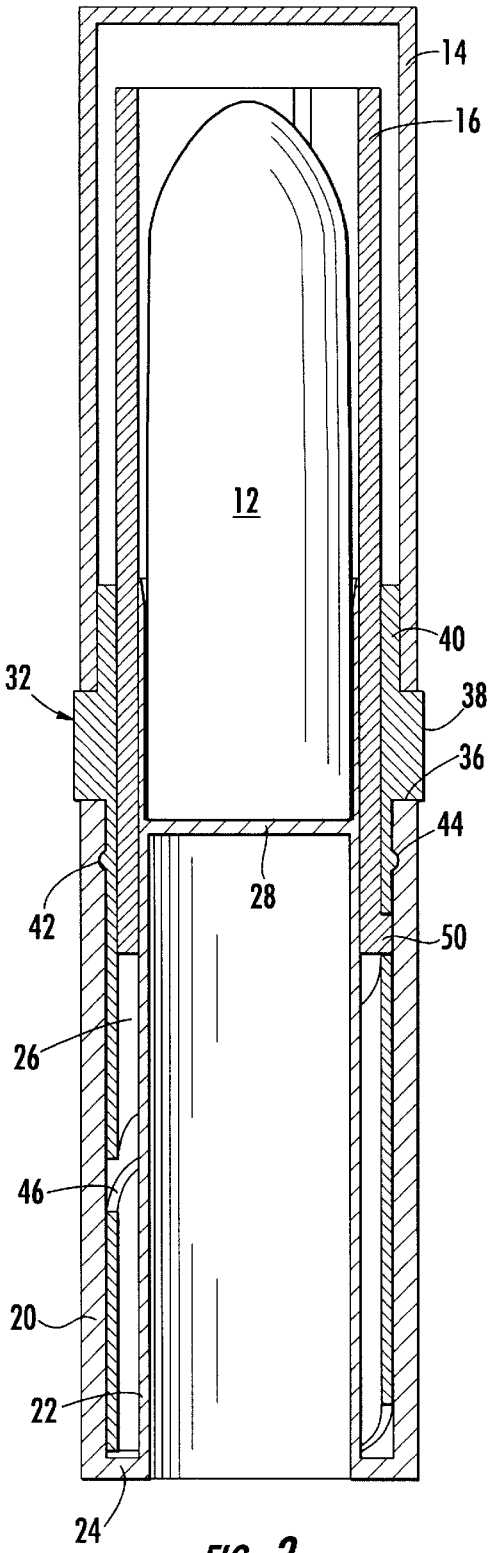
FIG. 3 is a vertical cross sectional view of the cosmetic package, shown with the cap in place.
Figure 4:
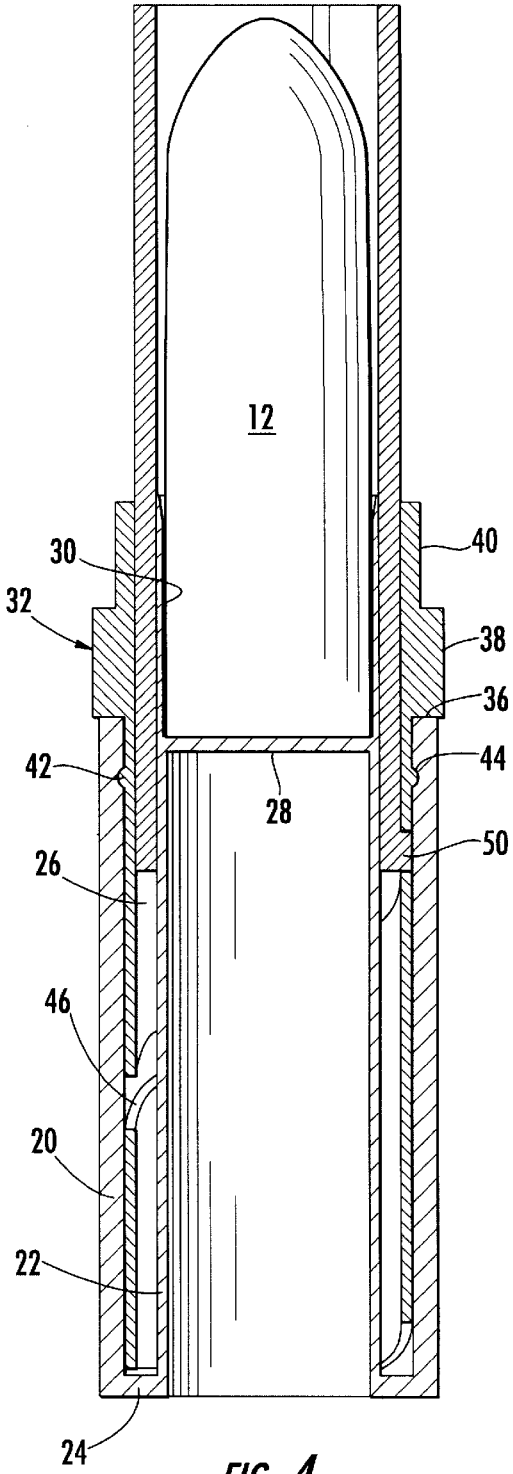
FIG. 4 is a cross-sectional view similar to FIG. 3 but with the cap removed.
Figure 5:
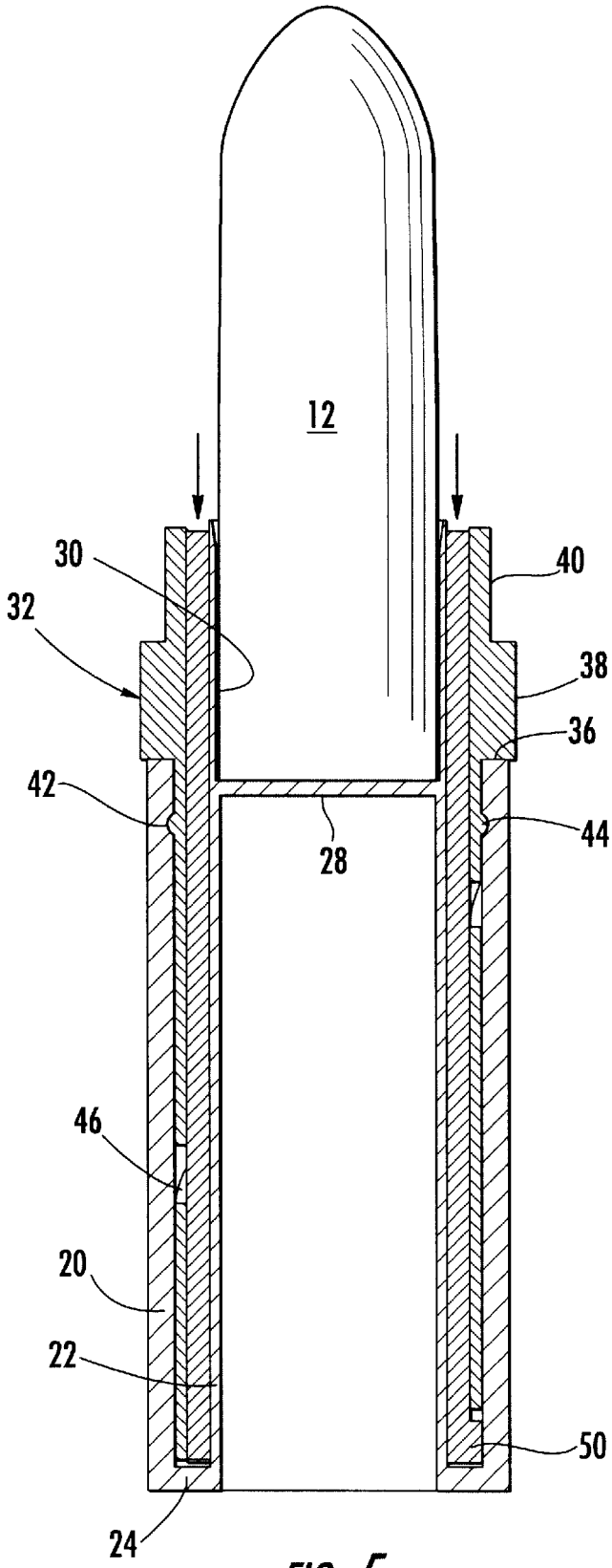
FIG. 5 is a vertical cross-sectional view similar to FIG. 4, but wherein the protective sleeve is in the retracted position.

The lipstick 12 projects upwardly from the upper end of a one-piece base 18. The one-piece base 18 includes a bottom 24, an outer cylindrical wall 20 projecting upwardly from the bottom 24 and terminating at an upper end, and an inner cylindrical wall 22 spaced inwardly of the outer cylindrical wall 20 and defining an annular space 26 therebetween, the inner cylindrical wall 22 projecting upwardly from the bottom 24 beyond the upper end of the outer cylindrical wall 20, and the upper end of the inner cylindrical wall 22 defining a cup 30 adapted for receiving and holding the stick cosmetic 12. As is seen more clearly from FIG. 2, the base 18 includes an outer cylindrical wall 20 and an inner cylindrical wall 22 which are joined at the bottom 24 and form an annular space 26 therebetween. The inner cylindrical wall 22 has a height greater than that of the outer cylindrical wall 20 and thus projects upwardly above the upper end of the outer cylindrical wall. A laterally extending web portion 28 (FIGS. 3–5) is formed in an upper portion of the inner wall 22 to define a cup 30 adapted for receiving and holding the lipstick 12. In the embodiment shown, the web 28 is uninterrupted and extends completely across the bottom of the cup 30, although it will be recognized that the web 28 could extend only partially across the bottom of the cup a sufficient distance to support the underside of the lipstick.

A rotatable cylindrical collar 32 is carried by the base 18 at its upper end. The collar 32, more particularly, includes an exposed upper portion positioned adjacent an upper end of the outer cylindrical wall 20 and adapted for being manually rotated, and a concealed skirt portion 34 depending downwardly from the upper portion and located within the annular space 26. The exposed upper portion, more particularly, includes an enlarged diameter annular shoulder portion 36 which abuts against the upper end of the outer cylindrical wall 20 and defines an outwardly facing annular grasping surface 38 which the user can grasp in order to rotate the collar. Projecting upwardly from the annular shoulder portion 36 is a reduced diameter sleeve portion 40, which has an outer diameter corresponding to the inner diameter of the lower portion of cap 14, configured to receive and to provide a friction fit for retaining the cap 14 in place. Therefore, the cap 14 is removably connected to the collar 32.

The collar 32 is retained in place on the base 18 by means of an outwardly projecting rib 42 formed on an outer surface of the skirt portion 34. Rib 42 is snap fit into and retained by a corresponding inwardly facing groove 44 positioned to receive rib 42 and formed in the inner surface of the outer cylindrical wall 20.

A helical track 46 is formed in the skirt portion 34. In the embodiment illustrated, the helical track is defined by a slot formed entirely through the wall of the skirt portion 34. However, it will be appreciated that the helical track could be formed by a channel or groove formed along the interior surface of the skirt portion 34.

The helical track 46 cooperates with an outwardly projecting lug 50 formed on an outer surface portion of the protective sleeve 16 which is positioned coaxially within the collar 32 in the annular space 26. In the embodiment shown, a single lug is provided for cooperating with a single track formed in the skirt portion 34. However, more than one lug and corresponding tracks could be provided if desired.

Figure 2:
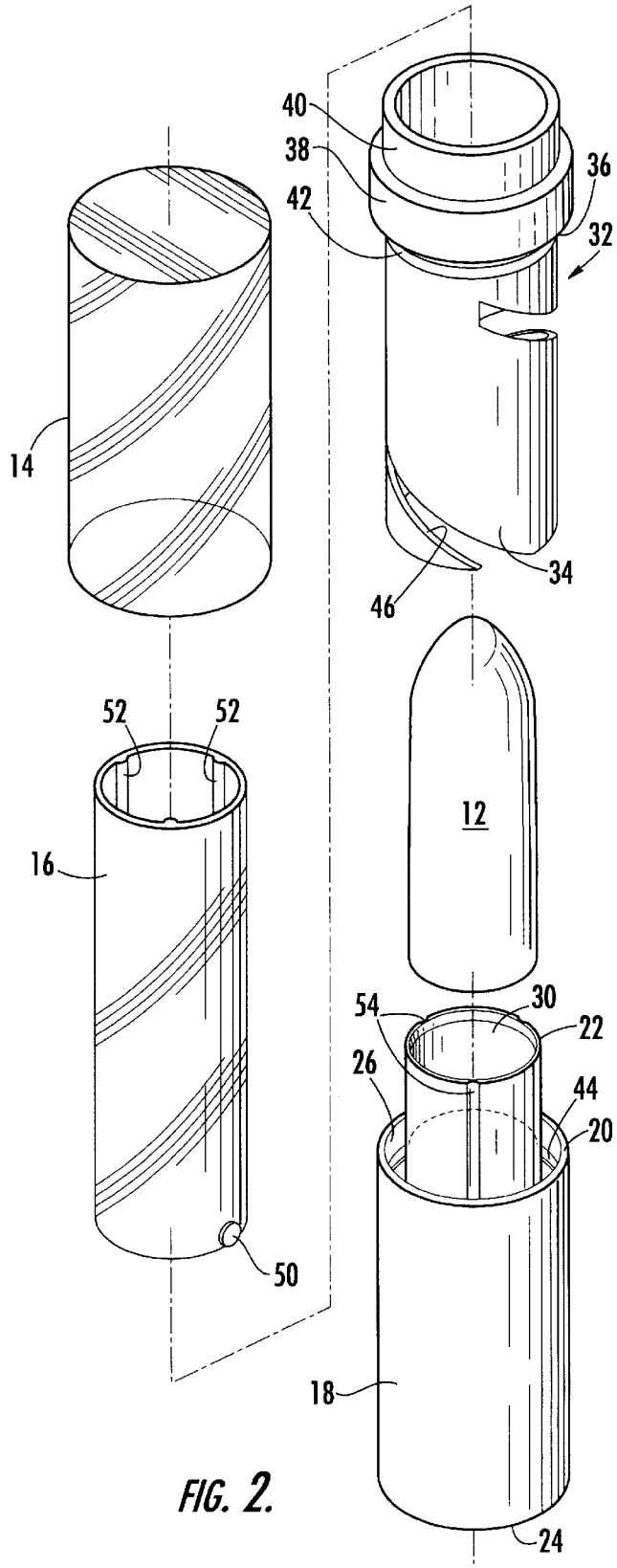
FIG. 2 is an exploded perspective view showing the components of the cosmetic package.

As best seen in FIG. 2, the interior surface of the protective sleeve 16 is provided with one or more inwardly projecting ribs 52 which extend longitudinally parallel to the axis of the sleeve 16. These ribs 52 cooperate with correspondingly shaped longitudinally extending grooves 54 formed in the outwardly facing surface of the inner cylindrical wall. The ribs 52 and grooves 54 cooperate to prevent rotation of the protective sleeve 16 relative to the base 18. Consequently, when the collar 32 is rotated, the lug 50 is forced to travel along the helical track 46, thereby extending or retracting the protective sleeve 16 axially. Thus, rotation of the collar 32 in a counterclockwise direction will move the protective sleeve upwardly into an extended position surroundingly protecting the lipstick 12. Movement of the collar 32 in a clockwise direction will retract the protective sleeve axially downwardly, exposing the lipstick 12 so that the user can apply it.

The protective sleeve 16 thus protects the lipstick against unwanted or accidental damage when removing or replacing the cap 14. In the embodiment illustrated, the protective sleeve 16 is formed of a transparent plastic material so that the color shade of the lipstick can be seen through the sleeve. Thus, when the cap 14 is formed of a transparent material as shown, the color shade of the lipstick remains visible when the cap 14 is in place. However it is within the scope of the present invention for sleeve 16 to be formed of an opaque or translucent material. It is also possible for the sleeve 16 to be sized so that when it is in the extended position, the tip of the lipstick projects beyond the upper end of the sleeve to reveal the color shade of the lipstick. In this instance, the sleeve 16 could be opaque rather than transparent, and the cosmetic package would still have a "shade evident" capability. The base 18 and the collar 32 are formed of an opaque plastic material.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiment disclosed and that modifications and other embodiments are intended to be included within the scope of the appended claims. Although specific terms are employed herein, they are used in a generic and descriptive sense only and not for purposes of limitation.

That which is claimed is:

1. A cosmetic package for a stick cosmetic, such as lipstick, comprising:

a base having inner and outer cylindrical walls defining an annular space therebetween and a cup adapted for receiving and holding the stick cosmetic;

a rotatable collar carried by said base; and a protective sleeve positioned in the annular space between said inner and outer cylindrical walls and cooperating with said rotatable collar so as to be propelled in response to rotation of said collar between an axially extended position for protectively surrounding the stick cosmetic and an axially retracted position for exposing the cosmetic.

2. A cosmetic package according to claim 1, wherein each wall has a lower end and said base includes a bottom joining together the lower ends of said inner and outer cylindrical walls, and wherein said cup is formed in an upper portion of said inner cylindrical wall.

3. A cosmetic package according to claim 2, wherein said protective sleeve includes at least one outwardly projecting lug formed on an outer surface of the sleeve, and wherein said rotatable collar includes an exposed upper portion positioned adjacent an upper end of said outer cylindrical wall and adapted for being manually rotated, and a concealed skirt portion depending downwardly from said upper portion and located within said annular space, said skirt portion including a helical track cooperating with said at least one lug for propelling said protective sleeve axially in response to rotation of said collar.

4. A cosmetic package according to claim 3, wherein said inner cylindrical wall includes a plurality of outwardly facing longitudinally extending grooves on its outer surface, and said protective sleeve includes a plurality of inwardly projecting longitudinally extending ribs on its inner surface cooperating with said outwardly facing grooves on said inner wall.

5. A cosmetic package according to claim 3, wherein said protective sleeve is transparent.

6. A cosmetic package according to claim 5, additionally including a transparent tubular cap removably connected to said collar and positioned to surround a major portion of said transparent protective sleeve.

7. A cosmetic package according to claim 6, wherein said exposed upper portion of said rotatable collar includes an enlarged diameter annular shoulder portion abutting against an upper end of said outer wall and defining an outwardly facing annular grasping surface for rotation of the collar and a reduced diameter sleeve portion projecting upwardly from said annular shoulder portion and configured for receiving and frictionally retaining said tubular cap.

8. A cosmetic package for a stick cosmetic, such as lipstick, comprising:

one-piece base which includes a bottom, an outer cylindrical wall projecting upwardly from said bottom and terminating at an upper end, and an inner cylindrical wall spaced inwardly of said outer cylindrical wall and defining an annular space therebetween, said inner cylindrical wall projecting upwardly from said bottom beyond the upper end of said outer wall, and the upper end of said inner cylindrical wall defining a cup adapted for receiving and holding the stick cosmetic;

a rotatable collar carried by said base, said collar including an exposed upper portion positioned adjacent said upper end of said outer cylindrical wall and adapted for being manually rotated, and a concealed skirt portion depending downwardly from said upper portion and located within said annular space, said skirt portion including a helical track; and a protective sleeve positioned coaxially within said collar in the annular space between said inner and outer cylindrical walls, said sleeve including at least one outwardly projecting lug cooperating with said helical track so that the sleeve is propelled in response to rotation of said collar between an axially extended position for protectively surrounding the stick cosmetic and an axially retracted position for exposing the cosmetic.

9. A cosmetic package according to claim 8, including means for retaining the sleeve in assembled position with said base.

10. A cosmetic package according to claim 9, wherein said retaining means includes an outwardly projecting rib formed on an outer surface of said skirt portion, and a corresponding inwardly facing groove formed on an inner surface of said outer wall and positioned to receive said rib.

11. A cosmetic package according to claim 8, wherein said inner cylindrical wall includes a plurality of outwardly facing longitudinally extending grooves on its outer surface, and said protective sleeve includes a plurality of inwardly projecting longitudinally extending ribs on its inner surface cooperating with said outwardly facing grooves on said inner wall.

12. A cosmetic package according to claim 8, wherein said protective sleeve is transparent.

13. A cosmetic package according to claim 12, additionally including a transparent tubular cap removably connected to said collar and positioned to surround a major portion of said transparent protective sleeve.

14. A cosmetic package according to claim 13, wherein said protective sleeve and said tubular cap are formed of a transparent plastic material, and said base and said collar are formed of an opaque plastic material.

* * * * *